US010253590B2

(12) United States Patent
Xu et al.

(10) Patent No.: US 10,253,590 B2
(45) Date of Patent: Apr. 9, 2019

(54) DOWNHOLE TOOLS HAVING CONTROLLED DISINTEGRATION AND APPLICATIONS THEREOF

(71) Applicants: YingQing Xu, Tomball, TX (US); Zhihui Zhang, Katy, TX (US); Zhiyue Xu, Cypress, TX (US)

(72) Inventors: YingQing Xu, Tomball, TX (US); Zhihui Zhang, Katy, TX (US); Zhiyue Xu, Cypress, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 0 days.

(21) Appl. No.: 15/429,761

(22) Filed: Feb. 10, 2017

(65) Prior Publication Data

US 2018/0230769 A1 Aug. 16, 2018

(51) Int. Cl.

| | |
|---|---|
| ***E21B 33/12*** | (2006.01) |
| *C06B 33/00* | (2006.01) |
| *C06B 33/06* | (2006.01) |
| *C06B 33/12* | (2006.01) |

(52) U.S. Cl.

CPC ..... *E21B 33/1204* (2013.01); *E21B 33/1208* (2013.01); *C06B 33/00* (2013.01); *C06B 33/06* (2013.01); *C06B 33/12* (2013.01)

(58) Field of Classification Search

CPC ... E21B 33/1208; E21B 34/14; E21B 33/1204
See application file for complete search history.

(56) References Cited

U.S. PATENT DOCUMENTS

| | | | | |
|---|---|---|---|---|
| 5,990,051 | A | 11/1999 | Ischy et al. | |
| 8,528,633 | B2 | 9/2013 | Agrawal et al. | |
| 9,101,978 | B2 | 8/2015 | Xu et al. | |
| 2009/0078408 | A1 | 3/2009 | Richard et al. | |
| 2012/0181020 | A1 | 7/2012 | Barron et al. | |
| 2012/0205121 | A1* | 8/2012 | Porter | E21B 34/14 166/373 |

(Continued)

FOREIGN PATENT DOCUMENTS

| | | | |
|---|---|---|---|
| WO | 2015139111 | A1 | 9/2015 |
| WO | 2015187524 | A1 | 12/2015 |

OTHER PUBLICATIONS

Binauld et al. "Acid-degradable polymers for drug delivery: a decade of innovation", Chem. Commun., 2013, 49; pp. 2082-2102.

(Continued)

*Primary Examiner* — D. Andrews
*Assistant Examiner* — Kristyn A Hall
(74) *Attorney, Agent, or Firm* — Cantor Colburn LLP

(57) ABSTRACT

A downhole assembly comprises a first article; and a second article having a surface which accommodates a surface shape of the first article, wherein the first article is configured to provide a chemical, heat, or a combination thereof to facilitate the disintegration of the second article. A method comprises disposing a second article in a downhole environment; disposing a first article on the second article; the second article having a surface which accommodates a surface shape of the first article; performing a downhole operation; and disintegrating the first article to provide a chemical, heat, or a combination thereof that facilitates the disintegration of the second article.

19 Claims, 3 Drawing Sheets

(56) References Cited

U.S. PATENT DOCUMENTS

| | | | | |
|---|---|---|---|---|
| 2013/0081815 | A1 | 4/2013 | Mazyar et al. | |
| 2014/0020708 | A1 | 1/2014 | Kim et al. | |
| 2014/0196899 | A1* | 7/2014 | Jordan | C22C 1/0416 166/284 |
| 2015/0159462 | A1* | 6/2015 | Cutler | E21B 33/12 166/377 |
| 2015/0239795 | A1* | 8/2015 | Doud | C06B 45/32 428/649 |
| 2016/0130906 | A1* | 5/2016 | Garvey | E21B 34/063 166/376 |
| 2016/0201427 | A1 | 7/2016 | Fripp et al. | |
| 2016/0230494 | A1* | 8/2016 | Fripp | E21B 33/134 |
| 2016/0333668 | A1 | 11/2016 | Xu et al. | |
| 2018/0258722 | A1 | 9/2018 | Allen | |

OTHER PUBLICATIONS

International Search Report, International Application No. PCT/US2018/013123, dated Apr. 17, 2018, Korean Intellectual Property Office; International Search Report 4 pages.

International Written Opinion, International Application No. PCT/US2018/013123, dated Apr. 17, 2018, Korean Intellectual Property Office; International Written Opinion 7 pages.

* cited by examiner

DOWNHOLE TOOLS HAVING CONTROLLED DISINTEGRATION AND APPLICATIONS THEREOF

BACKGROUND

Certain downhole operations involve placement of articles in a downhole environment, where the article performs its function, and is then removed. For example, articles such as ball/ball seat assemblies and fracture (frac) plugs are downhole articles used to seal off lower zones in a borehole in order to carry out a hydraulic fracturing process (also referred to in the art as "fracking") to break up reservoir rock. After the fracking operation, the ball/ball seat or plugs are then removed to allow fluid flow to or from the fractured rock.

To facilitate removal, such articles may be formed of a material that reacts with a downhole fluid so that they need not be physically removed by, for example, a mechanical operation, but may instead corrode or disintegrate under downhole conditions. However, because operations such as fracking may not be undertaken for days or months after the borehole is drilled, such tools may have to be immersed in downhole fluids for extended periods of time before the fracking operation begins. Therefore, it is desirable to have downhole articles such as ball seats and frac plugs that are inert to the downhole environment or have controlled corrosion during that period of time, and which then can rapidly disintegrate after the tool function is complete.

BRIEF DESCRIPTION

A downhole assembly comprises a first article; and a second article having a surface which accommodates a surface shape of the first article, wherein the first article is configured to provide a chemical, heat, or a combination thereof to facilitate the disintegration of the second article.

A method comprises disposing a second article in a downhole environment; disposing a first article on the second article; the second article having a surface which accommodates a surface shape of the first article; performing a downhole operation; and disintegrating the first article to provide a chemical, heat, or a combination thereof that facilitates the disintegration of the second article.

BRIEF DESCRIPTION OF THE DRAWINGS

The following descriptions should not be considered limiting in any way. With reference to the accompanying drawings, like elements are numbered alike.

DETAILED DESCRIPTION

Figure 1:
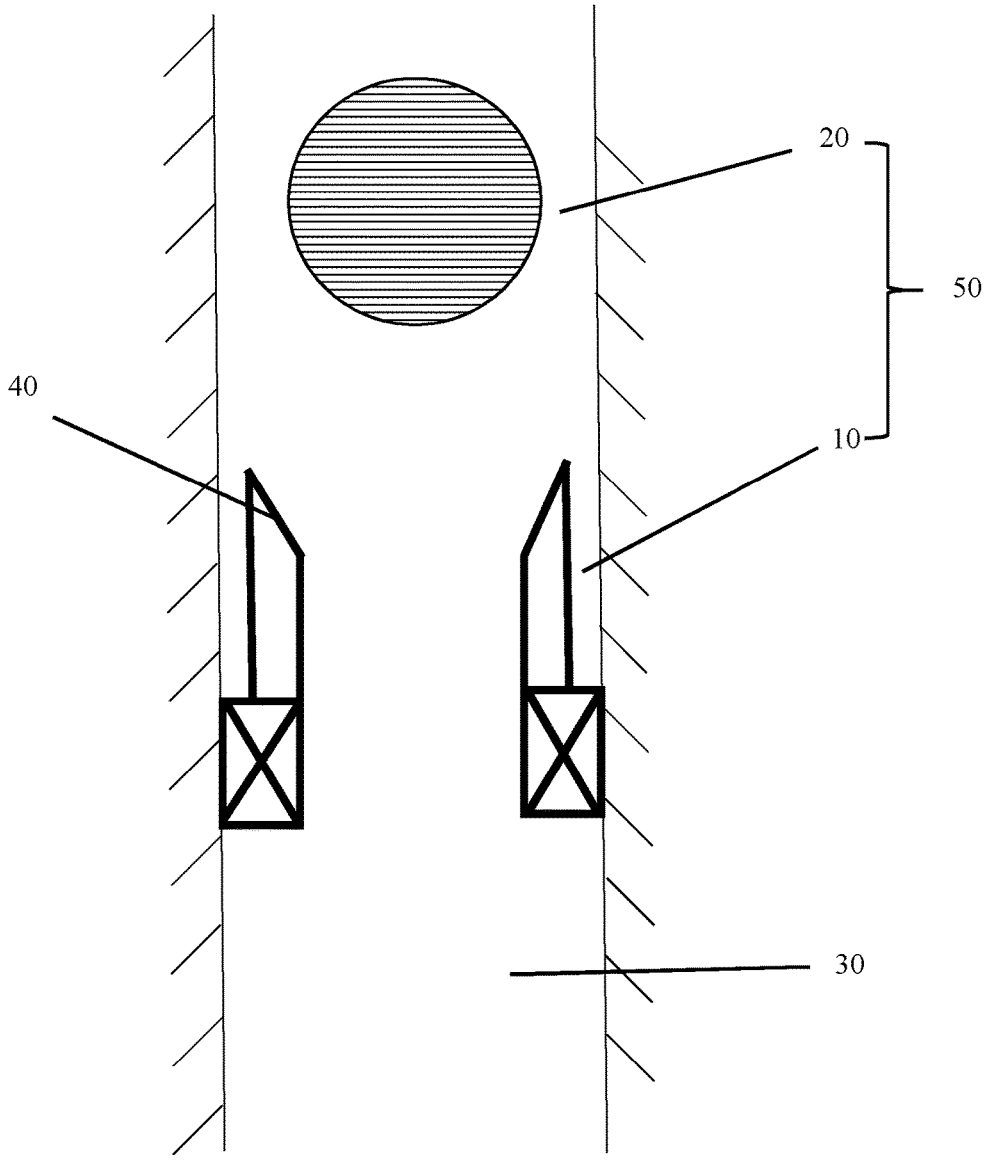
FIG. 1 shows a cross-sectional view of an exemplary downhole assembly according to an embodiment of the disclosure.

The disclosure provides downhole assemblies that include a first article and a second article having a surface that accommodates a surface shape of the first article. The second article has minimized disintegration rate or no disintegration in a downhole environment so that it can be exposed to a downhole environment for an extended period of time without compromising its structural integrity. In use, the first article can be disposed on the second article, and together, the first article and the second article form a seal or pressure barrier. After a downhole operation is completed, the first article is configured to provide a chemical, heat, or a combination thereof to facilitate the disintegration and rapid removal of the second article. The first article itself can also disintegrate thus removed from the downhole environment.

In an embodiment, the first article comprises a core and one or more layers surrounding the core. The layers surrounding the core comprise a corrodible material. The thickness and the material of the layers are selected such that while the first article travels downhole or disposed on the second article when a downhole operation is performed, the layers protect and isolate the core from the downhole fluid. But when the function of the downhole assembly is completed, the layers surrounding the core corrode to such an extent that the core is at least partially exposed to the downhole fluid. The exposed core release a disintegrating agent which creates a corrosive environment to facilitate the disintegration of the second article.

In another embodiment, the first article comprises a disintegrating agent embedded in a matrix comprising a corrodible material. The disintegrating agent can be uniformly distributed throughout the matrix or unevenly distributed in the matrix. For example, a concentration of the disintegrating agent can increase from the center of the first article to the surface of the first article. Upon the disintegration of the matrix, the disintegrating agent is released to accelerate the disintegration of the second article.

In yet another embodiment, the first article comprises a polymeric or metallic member; a degradable polymer shell disposed on the polymeric or metallic member; and an activating material, which can be disposed between the shell and the polymeric or metallic member in an embodiment. The polymer shell allows the first article to conform to the surface shape of the second particle. While the downhole assembly is in use, the shell isolates the activating material from the downhole fluid. When the downhole assembly is no longer needed, the shell degrades exposing the activating material, which creates a corrosive environment to accelerate the disintegration of the second article.

As used herein, a disintegrating agent includes one or more of the following: an acid; a salt; or a material effective to generate an acid, an inorganic salt, heat, or a combination thereof upon reacting with a downhole fluid. Exemplary disintegrating agent includes an acidic oxide, an acidic salt, a neutral salt such as KBr, a basic salt, an organic acid in a solid form such as sulfamic acid; sodium metal; or potassium metal. Combinations of the materials can be used.

The corrodible material in the one or more layers surrounding the core or in the matrix comprises a metal, a metal composite, or a combination comprising at least one of the foregoing. As used herein, a metal includes metal alloys. The corrodible material is corrodible in a downhole fluid, which can be water, brine, acid, or a combination comprising at least one of the foregoing. In an embodiment, the downhole fluid includes potassium chloride (KCl), hydrochloric acid (HCl), calcium chloride ($CaCl_2$), calcium bromide ($CaBr_2$) or zinc bromide ($ZnBr_2$), or a combination comprising at least one of the foregoing.

Exemplary corrodible materials include zinc metal, magnesium metal, aluminum metal, manganese metal, an alloy thereof, or a combination comprising at least one of the foregoing. The shell matrix material can further comprise Ni, W, Mo, Cu, Fe, Cr, Co, an alloy thereof, or a combination comprising at least one of the foregoing.

Magnesium alloy is specifically mentioned. Magnesium alloys suitable for use include alloys of magnesium with aluminum (Al), cadmium (Cd), calcium (Ca), cobalt (Co), copper (Cu), iron (Fe), manganese (Mn), nickel (Ni), silicon (Si), silver (Ag), strontium (Sr), thorium (Th), tungsten (W), zinc (Zn), zirconium (Zr), or a combination comprising at least one of these elements. Particularly useful alloys include magnesium alloyed with Ni, W, Co, Cu, Fe, or other metals. Alloying or trace elements can be included in varying amounts to adjust the corrosion rate of the magnesium. For example, four of these elements (cadmium, calcium, silver, and zinc) have to mild-to-moderate accelerating effects on corrosion rates, whereas four others (copper, cobalt, iron, and nickel) have a still greater effect on corrosion. Exemplary commercial magnesium alloys which include different combinations of the above alloying elements to achieve different degrees of corrosion resistance include but are not limited to, for example, those alloyed with aluminum, strontium, and manganese such as AJ62, AJ50x, AJ51x, and AJ52x alloys, and those alloyed with aluminum, zinc, and manganese such as AZ91A-E alloys.

It will be understood that the corrodible materials will have any corrosion rate necessary to achieve the desired performance of the downhole assembly once the downhole assembly completes its function. In a specific embodiment, the corrodible material has a corrosion rate of about 0.1 to about 450 $mg/cm^2$/hour, specifically about 1 to about 450 $mg/cm^2$/hour determined in aqueous 3 wt. % KCl solution at 200° F. (93° C.).

As used herein, a metal composite refers to a composite having a substantially-continuous, cellular nanomatrix comprising a nanomatrix material; a plurality of dispersed particles comprising a particle core material that comprises Mg, Al, Zn or Mn, or a combination thereof, dispersed in the cellular nanomatrix; and a solid-state bond layer extending throughout the cellular nanomatrix between the dispersed particles. The matrix comprises deformed powder particles formed by compacting powder particles comprising a particle core and at least one coating layer, the coating layers joined by solid-state bonding to form the substantially-continuous, cellular nanomatrix and leave the particle cores as the dispersed particles. The dispersed particles have an average particle size of about 5 μm to about 300 μm. The nanomatrix material comprises Al, Zn, Mn, Mg, Mo, W, Cu, Fe, Si, Ca, Co, Ta, Re or Ni, or an oxide, carbide or nitride thereof, or a combination of any of the aforementioned materials. The chemical composition of the nanomatrix material is different than the chemical composition of the particle core material.

The corrodible material can be formed from coated particles such as powders of Zn, Mg, Al, Mn, an alloy thereof, or a combination comprising at least one of the foregoing. The powder generally has a particle size of from about 50 to about 150 micrometers, and more specifically about 5 to about 300 micrometers, or about 60 to about 140 micrometers. The powder can be coated using a method such as chemical vapor deposition, anodization or the like, or admixed by physical method such cryo-milling, ball milling, or the like, with a metal or metal oxide such as Al, Ni, W, Co, Cu, Fe, oxides of one of these metals, or the like. The coating layer can have a thickness of about 25 nm to about 2,500 nm. Al/Ni and Al/W are specific examples for the coating layers. More than one coating layer may be present. Additional coating layers can include Al, Zn, Mg, Mo, W, Cu, Fe, Si, Ca, Co, Ta, or Re. Such coated magnesium powders are referred to herein as controlled electrolytic materials (CEM). The CEM materials are then molded or compressed forming the matrix by, for example, cold compression using an isostatic press at about 40 to about 80 ksi (about 275 to about 550 MPa), followed by forging or sintering and machining, to provide a desired shape and dimensions of the disintegrable article. The CEM materials including the composites formed therefrom have been described in U.S. Pat. Nos. 8,528,633 and 9,101,978.

The materials for the metallic member and the polymeric member provide the general material properties such as strength, ductility, hardness, density for tool functions. The metallic member can contain a metallic corrodible material as disclosed herein. The polymeric member contains a thermally degradable polymer, which degrades when subjected to heat. Exemplary thermally degradable polymer includes thermosetting and thermoplastic materials and their fiber-reinforced composites. The thermosetting material will decompose above their decomposition temperature and the thermoplastic material will melt above their melting point. In general the materials are selected from polymers which have a decomposition or melting temperature less than 350° C. or 650° F. Particularly, thermally degradable linkage is introduced to the polymeric structure to improve the degradability at the target temperatures. For example epoxy resins containing degradable linkages. Examples of degradable linkages include ester linkage, carbamate linkage, carbonate linkage, or a combination comprising at least one of the foregoing.

Exemplary degradable polymer shell comprises one or more of the following: polyethylene glycol; polyglycolic acid; polylactic acid; polycaprolactone; poly(hydroxyalkanoate); or a copolymer thereof.

The activating material comprises a solid acid such as sulfamic acid, a pyrotechnic heat source, or a combination comprising at least one of the foregoing. The pyrotechnic heat source includes a metal (a reducing agent) and an oxidizer. Exemplary activating materials include a combination of barium chromate and zirconium; a combination of potassium perchlorate and iron; a combination of boron, titanium, and barium chromate, or a combination of barium chromate, potassium perchlorate, and tungsten. Other exemplary activating materials include a metal powder (a reducing agent) and a metal oxide (an oxidizing agent), where choices for a reducing agent include aluminum, magnesium, calcium, titanium, zinc, silicon, boron, and combinations including at least one of the foregoing, for example, while choices for an oxidizing agent include boron oxide, silicon oxide, chromium oxide, manganese oxide, iron oxide, copper oxide, lead oxide and combinations including at least one of the foregoing, for example. Thermite-like compositions include a mixture of aluminum and nickel. Various combinations of the activating materials can be used. When exposed to a downhole fluid, the activating material is effective to release a chemical such as an acid and/or to generate heat, which facilitates the disintegration of the second article as well as the first article.

Optionally the first article further comprises a triggering device. The triggering device can be embedded in the polymeric/metallic member, the activating material, or the corrodible core, and is effective to generate a spark, an electrical current, or a combination thereof when a disintegration signal is received, or when a predetermined condition is met. Illustrative triggering devices include batteries or other electronic components that are controlled by a timer, a sensor, a signal source or a combination comprising at least one of the foregoing. Once a predetermined condition such as a threshold time, pressure, or temperature is met, or once a disintegration signal is received above the ground or in the wellbore, the triggering device generates spark or an electric current and activates the activating material.

The second article comprises a metallic corrosive material as disclosed herein. The first and second articles can further comprise additives such as carbides, nitrides, oxides, precipitates, dispersoids, glasses, carbons, or the like in order to control the mechanical strength and density of the articles if needed.

Optionally the second article has a surface coating such as a metallic layer that is resistant to corrosion by a downhole fluid. As used herein, "resistant" means the metallic layer is not corroded or has minimal controlled corrosion by corrosive downhole conditions encountered (i.e., brine, hydrogen sulfide, etc., at pressures greater than atmospheric pressure, and at temperatures in excess of 50° C.) such that any portion of the second article is exposed, for a period of greater than or equal to 24 hours or 36 hours.

The metallic layer includes any metal resistant to corrosion under ambient downhole conditions, and which can be removed by a downhole fluid in the presence of the chemicals and/or heat generated by the disintegrating agent or the activating agent. In an embodiment, the metallic layer includes aluminum alloy, magnesium alloy, zinc alloy or iron alloy. The metallic layer includes a single layer, or includes multiple layers of the same or different metals.

The metallic layer has a thickness of less than or equal to about 1,000 micrometers (i.e., about 1 millimeter). In an embodiment, the metallic layer may have a thickness of about 10 to about 1,000 micrometers, specifically about 50 to about 750 micrometers and still more specifically about 100 to about 500 micrometers. The metallic layer can be formed by any suitable method for depositing a metal, including an electroless plating process, or by electrodeposition.

Figure 2:
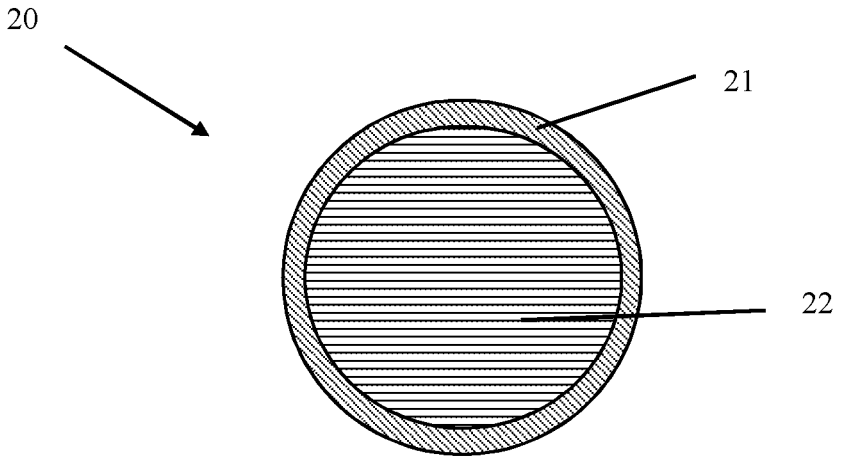
FIG. 2 illustrates an exemplary article of the downhole assembly, where the article includes a core and one or more layers surrounding the core.
Figure 3:
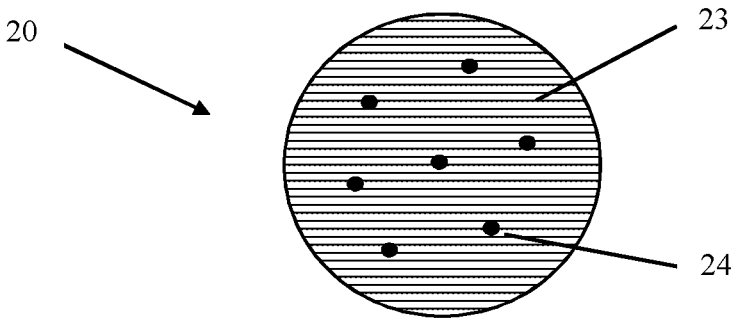
FIG. 3 illustrates an exemplary article of the downhole assembly, where the article comprises a disintegrating agent embedded in a matrix.
Figure 4:
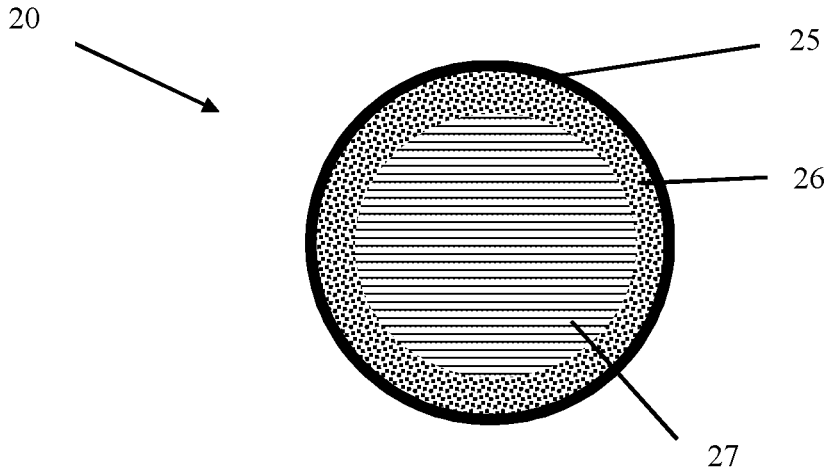
FIG. 4 illustrates an exemplary article of the downhole assembly, where the article comprises a polymeric or metallic member; a degradable polymer shell disposed on the polymeric or metallic member; and an activating material.
Figure 5:
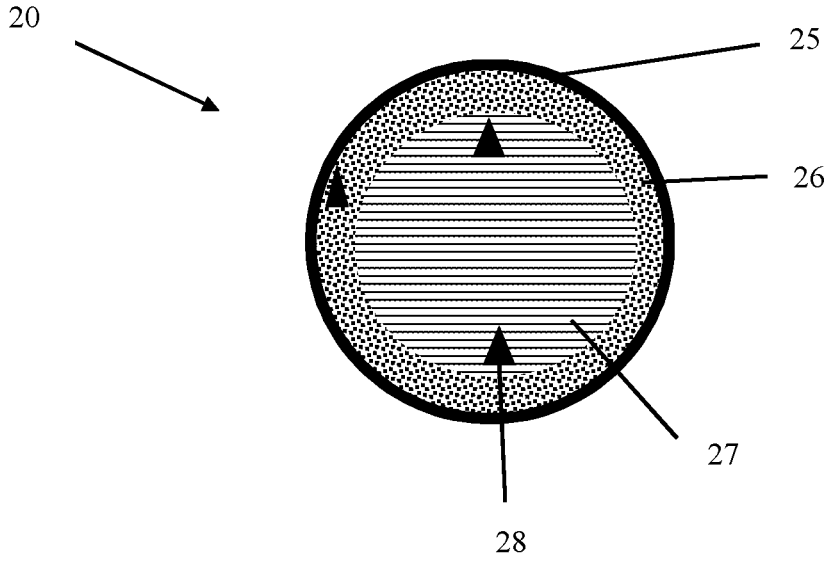
FIG. 5 illustrates an exemplary article of the downhole assembly, where the article comprises a polymeric or metallic member; a degradable polymer shell disposed on the polymeric or metallic member; an activating material; and a triggering device.

A downhole assembly and various exemplary embodiments of the articles of the downhole assembly are illustrated in FIGS. 1-5. Referring to FIG. 1, downhole assembly 50 includes first article 20 and second article 10, where second article 10 has a surface 40 that can accommodate a surface shape of the first article 20. The downhole assembly 50 is disposed in a downhole environment 30. FIG. 2 illustrates an exemplary first article 20, where the article 20 includes a core 22 and one or more layers 21 surrounding the core. In FIG. 3, first article 20 comprises matrix 23 and a disintegrating agent 24 embedded in the matrix. In FIG. 4, first article 20 has a polymeric or metallic member 27, a degradable polymer shell 25, and an activating material 26 disposed between the polymeric or metallic member 27 and the polymer shell 25. As shown in FIG. 5, a triggering device 28 can be embedded in the metallic or polymeric member 27 or embedded in the activating material 26.

In an embodiment, the second article can have a generally cylindrical shape that tapers in a truncated, conical cross-sectional shape with an inside diameter in cylindrical cross-section sufficient to allow a first article to fit downhole and to seat and form a seal or a pressure barrier together with the second article. In a further embodiment, the surface of the second article is milled to have a concave region having a radius designed to accommodate a first article. Exemplary first articles include a ball or a plug, and illustrative second articles include a ball seat or a frac plug.

In use, the second article is placed in a downhole environment, and if needed, for hours, days, or even months. Then the first article is disposed on the second article forming a seal or pressure barrier together with the second article. In an embodiment, disposing is accomplished by placing a first article in the downhole environment, and applying pressure to the downhole environment. Placing means, in the case of a ball seat, dropping a ball into the well pipe, and forcing the ball to settle to the ball seat by applying pressure.

Various downhole operations can be performed. The downhole operations are not particularly limited and can be any operation that is performed during drilling, stimulation, completion, production, or remediation.

Once the disintegrable assembly is no longer needed, the first article is disintegrated to provide a chemical, heat, or a combination thereof to facilitate the disintegration of the second article. In the event that the first article has a triggering device, the method further comprises generating a spark, a current, or a combination thereof to trigger the disintegration of the first article. The disintegration of the first article releases chemicals, heat, or a combination thereof which in turn accelerate the disintegration of the second article. In the instance where the first article comprises a core and one or more layers surrounding the core, the method further comprises removing one or more layers and exposing the core to a downhole fluid.

The metallic layer on the second article, if present, can be partially or completely removed by a downhole fluid in the presence of chemicals or heat generated during the disintegration of the first article.

Set forth below are various embodiments of the disclosure.

Embodiment 1. A downhole assembly comprising:

a first article; and a second article having a surface which accommodates a surface shape of the first article, wherein the first article is configured to provide a chemical, heat, or a combination thereof to facilitate the disintegration of the second article.

Embodiment 2. The downhole assembly of Embodiment 1, wherein the first article comprises a core and one or more layers surrounding the core.

Embodiment 3. The downhole assembly of Embodiment 2, wherein the core comprises a disintegrating agent that includes one or more of the following: an acid; a salt; or a material effective to generate an acid, an inorganic salt, heat, or a combination thereof upon reacting with a downhole fluid.

Embodiment 4. The downhole assembly of Embodiment 2, wherein the core comprises one or more of the following: an acidic oxide, an acidic salt, a neutral salt, a basic salt, an organic acid in a solid form; sodium metal; or potassium metal.

Embodiment 5. The downhole assembly of any one of Embodiments 2 to 4, wherein the one or more layers surrounding the core comprise zinc metal, magnesium metal, aluminum metal, manganese metal, an alloy thereof, or a combination comprising at least one of the foregoing.

Embodiment 6. The downhole assembly of any one of Embodiments 1 to 5, wherein the first article comprises a disintegrating agent embedded in a matrix, the disintegrating agent comprising one or more of the following: an acid; a salt; or a material effective to generate an acid, a salt, heat, or a combination thereof upon reacting with a downhole fluid.

Embodiment 7.The downhole assembly of Embodiment 6, wherein the matrix comprises Zn, Mg, Al, Mn, an alloy thereof, or a combination comprising at least one of the foregoing.

Embodiment 8. The downhole assembly of Embodiment 1, wherein the first article comprises a metallic or polymeric member; a degradable polymer shell disposed on the metallic or polymeric member; and an activating material.

Embodiment 9.The downhole assembly of Embodiment 8, wherein the activating material is disposed between the metallic or polymeric member and the degradable polymer shell.

Embodiment 10. The downhole assembly of Embodiment 8 or Embodiment 9, wherein metallic member comprises a metal, a metal composite, or a combination comprising at least one of the foregoing.

Embodiment 11. The downhole assembly of any one of Embodiments 8 to 10, wherein the polymeric member comprises a thermo degradable polymer.

Embodiment 12.The downhole assembly of any one of Embodiments 8 to 11, wherein the degradable polymer shell comprises one or more of the following: polyethylene glycol; polyglycolic acid; polylactic acid; polycaprolactone; poly(hydroxyalkanoate); or a copolymer thereof.

Embodiment 13. The downhole assembly of any one of Embodiments 8 to 12, wherein the activating material comprises a solid acid, a pyrotechnic heat source, or a combination comprising at least one of the foregoing.

Embodiment 14. The downhole assembly of Embodiment 13, wherein the pyrotechnic heat source comprises a metal reducing agent and an oxidizer.

Embodiment 15. The downhole assembly of Embodiment 14, wherein the pyrotechnic heat source comprises one or more of metal fuels and oxides or salt-based oxidizers, for example the following: a combination of barium chromate and zirconium; a combination of potassium perchlorate and iron; a combination of boron, titanium, and barium chromate, or a combination of barium chromate, potassium perchlorate, and tungsten.

Embodiment 16. The downhole assembly of any one of Embodiments 1 to 15, wherein the second article comprises one or more following: zinc metal; magnesium metal; aluminum metal; manganese metal; or an alloy thereof.

Embodiment 17. The downhole assembly of Embodiment 16, wherein the second article further comprises one or more of the following: Ni; W; Mo; Cu; Fe; Cr; Co; or an alloy thereof.

Embodiment 18. The downhole assembly of any one of Embodiments 1 to 17, wherein the second article has a surface coating that is resistant to corrosion by a downhole fluid.

Embodiment 19. The downhole assembly of any one of Embodiments 1 to 18, further comprising a triggering device disposed in the first article.

Embodiment 20. The downhole assembly of Embodiment 19, wherein the triggering device is effective to generate a spark, an electrical current, or a combination thereof when a predetermined condition is met or when a disintegration signal is received.

Embodiment 21. The downhole assembly of any one of Embodiments 1 to 20, wherein the first article is a ball or a plug, and the second article is a ball seat or a frac plug.

Embodiment 22. A method comprising:

disposing a second article in a downhole environment;

disposing a first article on the second article; the second article having a surface which accommodates a surface shape of the first article;

performing a downhole operation; and disintegrating the first article to provide a chemical, heat, or a combination thereof that facilitates the disintegration of the second article.

Embodiment 23. The method of Embodiment 22, further comprising generating a spark, a current, or a combination thereof to trigger the disintegration of the first article.

Embodiment 24. The method of Embodiment 22 or Embodiment 23, wherein the first article comprises a core and one or more layers surrounding the core, and the method further comprises removing one or more layers and exposing the core to a downhole fluid.

All ranges disclosed herein are inclusive of the endpoints, and the endpoints are independently combinable with each other. As used herein, "combination" is inclusive of blends, mixtures, alloys, reaction products, and the like. All references are incorporated herein by reference in their entirety.

The use of the terms "a" and "an" and "the" and similar referents in the context of describing the invention (especially in the context of the following claims) are to be construed to cover both the singular and the plural, unless otherwise indicated herein or clearly contradicted by context. "Or" means "and/or." The modifier "about" used in connection with a quantity is inclusive of the stated value and has the meaning dictated by the context (e.g., it includes the degree of error associated with measurement of the particular quantity).

What is claimed is:

1. A downhole assembly comprising, a first article comprises a metallic or polymeric member; a degradable polymer shell disposed on the metallic or polymeric member; and an activating material; and a second article having a surface which accommodates a surface shape of the first article;

wherein the first article is configured to provide a chemical, heat, or a combination thereof to facilitate the disintegration of the second article; the first article is a ball or a plug, and the second article is a ball seat or a frac plug.

2. The downhole assembly of claim 1, wherein the activating material is disposed between the metallic or polymeric member and the degradable polymer shell.

3. The downhole assembly of claim 1, wherein metallic member comprises a metal, a metal composite, or a combination comprising at least one of the foregoing.

4. The downhole assembly of claim 1, wherein the polymeric member comprises a thermo degradable polymer.

5. The downhole assembly of claim 1, wherein the degradable polymer shell comprises one or more of the following: polyethylene glycol; polyglycolic acid; polylactic acid; polycaprolactone; poly(hydroxyalkanoate); or a copolymer thereof.

6. The downhole assembly of claim 1, wherein the activating material comprises a solid acid, a pyrotechnic heat source, or a combination comprising at least one of the foregoing.

7. The downhole assembly of claim 6, wherein the pyrotechnic heat source comprises a metal reducing agent and an oxidizer.

8. The downhole assembly of claim 7, wherein the pyrotechnic heat source comprises one or more of metal fuels and oxides or salt-based oxidizers.

9. The downhole assembly of claim 8, wherein the pyrotechnic heat source comprises a combination of barium chromate and zirconium; a combination of potassium perchlorate and iron; a combination of boron, titanium, and barium chromate, or a combination of barium chromate, potassium perchlorate, and tungsten.

10. The downhole assembly of claim 1, wherein the second article comprises a magnesium alloy.

11. The downhole assembly of claim 1, wherein the second article further comprises one or more of the following: Ni; W; Mo; Cu; Fe; Cr; Co; or an alloy thereof.

12. The downhole assembly of claim 1, wherein the second article has a surface coating that is resistant to corrosion by a downhole fluid.

13. The downhole assembly of claim 1, further comprising a triggering device disposed in the first article.

14. The downhole assembly of claim 13, wherein the triggering device is effective to generate a spark, an electrical current, or a combination thereof when a predetermined condition is met or when a disintegration signal is received.

15. A method comprising:

disposing a second article in a downhole environment;

disposing a first article on the second article; the second article having a surface which accommodates a surface shape of the first article;

performing a downhole operation;

disintegrating the first article to provide a chemical, heat, or a combination thereof that facilitates the disintegration of the second article; and disintegrating the second article.

16. The method of claim 15, further comprising generating a spark, a current, or a combination thereof to trigger the disintegration of the first article.

17. The method of claim 15, wherein the first article comprises a core and one or more layers surrounding the core, and the method further comprises removing one or more layers and exposing the core to a downhole fluid.

18. The method of claim 15, wherein the first article is a ball or a plug, and the second article is a ball seat or a frac plug.

19. The method of claim 15, wherein the first article is disposed after the second article is disposed in the downhole environment.

* * * * *